US005524704A

United States Patent [19]

Stouvenot et al.

[11] Patent Number: 5,524,704

[45] Date of Patent: Jun. 11, 1996

[54] PROCESS AND DEVICE FOR THE CONTINUOUS CASTING OF VERY SMALL-DIAMETER WIRES DIRECTLY FROM LIQUID METAL

[75] Inventors: François Stouvenot, Jarny; Christian Gatellier, Montigny-Lés-Metz; Florence Bertrand, Metz; James Naylor, Ennery, all of France

[73] Assignee: Unimetal, Societe Francaise des Aciers Longs, Rombas, France

[21] Appl. No.: 383,734

[22] Filed: Feb. 6, 1995

[30] Foreign Application Priority Data

Feb. 14, 1994 [FR] France ..... 94 01797

[51] Int. Cl.[6] ..... B22D 11/06

[52] U.S. Cl. ..... 164/463; 164/423

[58] Field of Search ..... 164/423, 463, 164/80, 133, 335, 900

[56] References Cited

U.S. PATENT DOCUMENTS

| | | | |
|---|---|---|---|
| 2,963,530 | 12/1960 | Hanks et al. | 164/80 |
| 4,184,532 | 1/1980 | Bedell et al. | 164/463 |
| 4,741,384 | 5/1988 | Healey et al. | 164/514 |

FOREIGN PATENT DOCUMENTS

| | | |
|---|---|---|
| 0039169 | 11/1981 | European Pat. Off. . |
| 0089134 | 9/1983 | European Pat. Off. . |
| 60-21162 | 2/1985 | Japan . |
| 60-87952 | 5/1985 | Japan . |
| 61-262451 | 11/1986 | Japan . |
| 62-286652 | 12/1987 | Japan . |
| 1309766 | 12/1989 | Japan . |

*Primary Examiner*—Richard K. Seidel
*Assistant Examiner*—Randolph Herrick
*Attorney, Agent, or Firm*—Sixbey, Friedman, Leedom & Ferguson

[57] ABSTRACT

The subject of the invention is a process for the continuous casting of very small-diameter wires directly from liquid metal, according to which said liquid metal is made to flow out of a heated and pressurized container made of refractory material, forming a jet of liquid. metal having a diameter equal to or slightly greater than that of the wire to be cast, and said jet is made to solidify by making it penetrate into a layer of moving cooling liquid deposited on the internal wall of a drum rotating about a horizontal axis, wherein said container is fed, continuously or intermittently, with solid metal without interrupting casting and wherein said solid metal is melted inside said container.

The subject of the invention is also a device for the continuous casting of very small-diameter wires directly from liquid metal, allowing this process to be implemented.

Figure for the abstract: Single figure

9 Claims, 1 Drawing Sheet

PROCESS AND DEVICE FOR THE CONTINUOUS CASTING OF VERY SMALL-DIAMETER WIRES DIRECTLY FROM LIQUID METAL

FIELD OF THE INVENTION

The present invention relates to the field of the continuous casting of very small-diameter wires obtained directly from liquid metal.

PRIOR ART

A casting process has been developed over the last few years which makes it possible to obtain, directly from liquid metal, wires of indefinite length, of substantially circular cross section and of very small diameter, possibly going down to approximately 80 μm. This process is described especially in European Patent EP 0,039,169. It consists in forming a jet of metal from a liquid-metal container, this container being pressurized and fitted with heating means and with an outlet nozzle whose diameter is equal to or slightly greater than the diameter of the wire desired. This jet of metal then penetrates into a layer of cooling liquid, such as water or an aqueous solution of a salt which, for example, may be sodium, magnesium or zinc chloride, and which solidifies the wire. This layer of liquid is in movement in a direction transverse to that of the jet of metal. This layer of liquid flows over a solid surface [which imparts its own movement to it] constituted by the inside of a drum rotating about a horizontal axis. The rotation of the drum imparts movement to the layer of liquid flowing over it. The liquid-metal container is contained within the hollow part of the drum.

As it is being cast, the wire is wound inside the drum under the effect of the centrifugal force, or is extracted from the drum and coiled on the outside of the latter as it is being formed.

This process is often designated by the terms "Rotating Water Spinning" (RWS) or "water wheel". By virtue of the high cooling rate provided by it, this process makes it possible to obtain, for certain alloy compositions, amorphous wires of uniform size having, among other properties, a very high tensile strength. It is thus possible to cast amorphous wires of alloys based on various metals, such as iron, copper, cobalt, gold, aluminum, etc.

However, such devices have a major drawback with regard to industrialization. As mentioned, the liquid-metal container lies within the space left free inside the drum, and since the inside diameter of the latter does not exceed a few tens of cm, it is not possible to place in it a container whose capacity exceeds a few kg of metal. An industrial installation could therefore not cast a very great length of wire before it would be necessary to stop casting in order to recharge the container. Under these conditions, the productivity of the installation would be poor and its profitability would be substantially affected thereby.

It has been endeavored to alleviate this drawback by no longer depositing the cooling fluid on a rotating drum but on a moving belt which has a plane or curved shape on that part of its travel where solidification and cooling of the wire takes place (see the document EP 0,089,134). Since the space overhanging the belt is completely open, it is possible to put a container in it which has a very high capacity. However, it is necessary to feed the belt with cooling fluid in a continuous manner by means of a pipe emerging in its vicinity. This feed is inevitably accompanied by the creation of turbulence within the liquid. This turbulence must absolutely be dissipated upstream of the point of penetration of the jet of metal into the liquid. It is only under this condition that solidification of the jet takes place in a fluid in laminar flow and can result in the formation of a continuous wire of constant dimensions and of cross section as circular as possible. [This implies that] Hence in the moving belt device the distance between the point of arrival of the cooling liquid on the belt and the point of penetration of the jet of metal [is great (several meters)] must be several meters in order for the turbulence to dissipate, which requires the device to be large. Moreover, it is necessary to provide an installation for recovering and recycling the cooling fluid, since the latter leaves the belt after having performed its function. This drawback does not exist in the devices of the drum type since the liquid is put in just once, during the start-up phase of the casting operation and does not, in general, need to be replenished during casting (especially if the drum is internally cooled, so as to keep the temperature of the liquid constant). If the drum rotates at a constant speed, the liquid circulates substantially at the same constant speed as its internal surface and laminar flow may be established without difficulty.

SUMMARY OF THE INVENTION

The object of the invention is to provide a device for the direct continuous casting of a fine wire from a jet of liquid metal, based on the "water wheel" principle and allowing uninterrupted casting of very great lengths of wire.

For this purpose, the subject of the invention is a process for the continuous casting of very small-diameter wires directly from liquid metal, according to which said liquid metal is made to flow out of a heated and pressurized container made of refractory material, forming a jet of liquid metal having a diameter equal to or slightly greater than that of the wire to be cast, and said jet is made to solidify by making it penetrate into a layer of moving cooling liquid deposited on the internal wall of a drum rotating about a horizontal axis, wherein said container is fed, continuously or intermittently, with solid metal without interrupting casting and wherein said solid metal is melted inside said container.

The subject of the invention is also a device for the continuous casting of very small-diameter wires directly from liquid metal, of the type comprising a drum fitted with means for setting it in rotation about a horizontal axis, a layer of a cooling liquid, deposited on the inside surface of said drum, a container, made of refractory material, containing said liquid metal and being fitted with an outlet orifice overhanging said layer of cooling liquid, means for melting and heating said liquid metal and means for injecting a pressurized neutral gas into said container, wherein the device includes a pressurized vessel containing said metal in the solid state in divided form, and means for feeding said container, continuously or intermittently, with said solid metal.

As will be understood, the invention consists in charging the container with solid metal continuously or intermittently by virtue of a device injecting into it said solid metal in divided form, that is to say as powder or granules, and not requiring casting to stop in order to carry out this charging. The solid metal added melts on being injected into the liquid metal already present in the container, and it is thus possible to permanently maintain a given quantity of liquid metal in the container and to ensure that the stable operating conditions of the device last.

DESCRIPTION OF THE DRAWING

The invention will be explained more clearly in the description which follows, given with reference to the single appended figure which depicts diagrammatically, in partial section, an example of its implementation.

The device for the direct casting of fine wire, depicted in the single figure, comprises, in a known manner, a casting drum 1. This drum 1 is in the form of a cylinder whose diameter is of the order of 500 to 700 mm and whose longitudinal axis is held horizontal. One of the plane inside faces of this cylinder constitutes the bottom 2 of the drum 1 and carries a shaft 28 centered on the longitudinal axis of the drum 1. This shaft 28 is connected to conventional means, not depicted, making it possible to set it in rotation at defined speeds (of the order of 300 rpm). The opposite plane face of the drum 1 is hollow over the greater part of its area, so as to leave remaining only a ring-shaped portion 3 which, together with the bottom 2 and the inside (generally cylindrical) surface 4 of the drum 1, defines a receptacle for the cooling fluid. Under the effect of the drum 1 being set in rotation, the cooling fluid which was deposited in this receptacle beforehand (or injected once the drum 1 has been set in rotation) is driven at a speed substantially equal to that of the inside surface 4 of the drum 1. It forms a layer 5 of thickness of the order of 10 to 20 mm over the entire inside perimeter of the drum 1.

Figure 1:
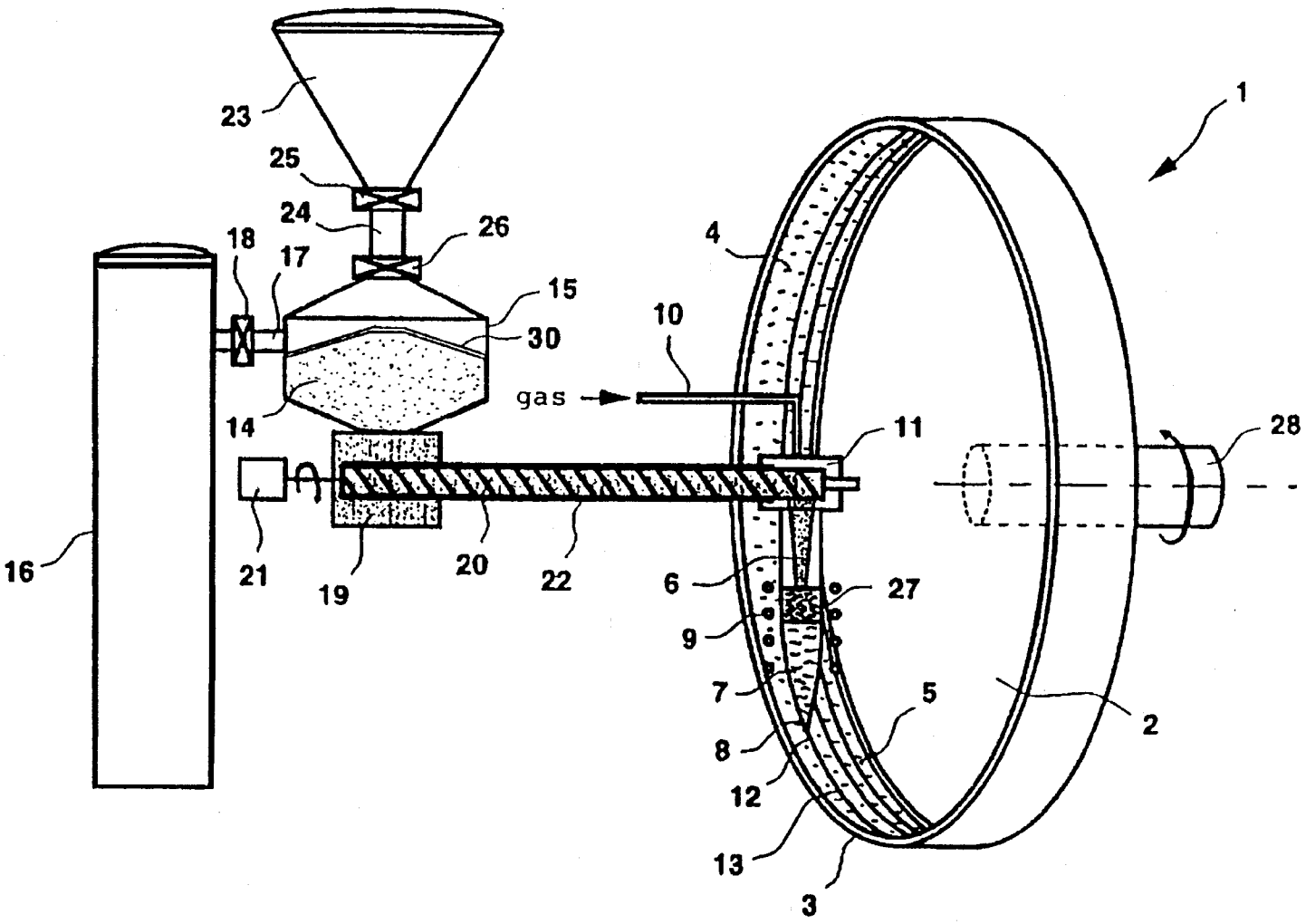

Still in a known manner, a container 6 made of refractory material (for example quartz or alumina) intended to contain the liquid metal 7 to be cast is located inside the drum 1. It is fitted with a bottom outlet orifice 8 of diameter equal to or slightly greater than that of the wire which it is desired to cast. A heating device, for example one comprising an induction coil 9 surrounding the container 6, melts the metal and holds it at the intended temperature, and causes slight stirring within it, this being favorable for its chemical and thermal homogeneity. A pipe 10, connected to the sealed lid 11 which covers the container 6, injects a neutral gas into the container 6 from a source, not depicted. The functions of this gas are to create, in the container 6, a noncontaminating (essentially oxygen-free) atmosphere for the liquid metal 7 and to create an overpressure (of the order of 3 to 10 bar) permitting outflow of the liquid metal 7 via the orifice 8. This outflow causes the formation of a jet 12 of liquid metal which penetrates into the layer 5 of cooling liquid. There it solidifies and forms a wire 13 of very small diameter and possibly of amorphous structure, if the nature of the metal and its cooling rate permit it. This wire 13 is driven by the cooling liquid 5 and is wound up inside the drum 1 (a few turns already formed have thus been depicted in FIG. 1), unless a device of a type known per se continually extracts and coils up the wire on the outside of the drum 1.

Normally, in the prior art, the metal is injected before casting in a solid form (powder, ingots, granules, etc.) into the container 6, which is then closed. The heating device 9 melts this metal and heats it, in the liquid state, up to the desired temperature. Thereafter, the gas overpressure is applied to the metal bath in the container 6, the bottom outlet orifice 8 of the container 6 is opened and the casting begins. It continues until the container 6 is more or less completely drained, and then it has to be interrupted in order for the recharging of the container 6 to take place.

According to the invention, the container 6 is fed with solid metal as follows. The metal 14 to be cast is stored in the solid state, in divided form, that is to say as powder or granules having a diameter of the order of 0.1 to 5 mm, in a closed vessel 15. This vessel 15 is kept at a pressure equal to that prevailing in the container 6 of liquid metal 7. For this purpose, a reserve 16 of inert gas is connected via a pipe 17 and a valve 18. This reserve 16 may also constitute the source of inert gas which pressurizes the liquid-metal container 6. Passing through the vessel 15, in its bottom part 19, is a horizontal or possibly oblique Archimedean screw 20 driven in rotation, at a speed which can be adjusted as required by the operator, by virtue of a motor 21. The direction of rotation of the Archimedean screw 20 is chosen such that it causes extraction of the powder or granules of solid metal 14 out of the vessel 15. On the outside of the vessel 15, a tube 22, connected in a sealed manner at one of its ends to the bottom part 19 of the vessel 15, jackets the Archimedean screw 20 so as to confine the solid metal 14 and to enable it to be transported without generating excessive frictional forces between the flights of the screw 20 and the internal wall of the tube 22. The tube 22 is connected, also in a sealed manner, at its other end to the lid 11 of the liquid-metal container 6, and the Archimedean screw 20 discharges inside said container 6. It thus enables the powder or granules of solid metal 14 to be brought into the container 6. The solid metal 14 drops, simply by gravity, into the liquid metal 7 where it melts, and thus contributes to permanently keeping the quantity of liquid metal 7 contained in the container 6 at the desired value (if the addition is continuous) or to bringing this quantity up to the desired value (if the addition is intermittent). The flow rate of solid metal 14 penetrating into the container 6 may easily be adjusted by varying the speed of rotation of the Archimedean screw 20, after it has been experimentally determined, for a solid metal 14 of given nature and particle size, which flow rate corresponds to which speed.

As depicted in the single figure, the vessel 15 may itself be fed with solid metal 14 discontinuously from a second vessel 23 under atmospheric pressure. These two vessels 15 and 23 are separated by an airlock 24 which enables, by virtue of its two, upper 25 and lower 26, sealed valves, the vessel 15 to be fed without excessively disturbing the establishment of the overpressure necessary for the operation of the installation.

The solid metal 14 may not be perfectly clean, and it always includes, to a greater or lesser extent, a quantity of nonmetallic impurities, such as oxide inclusions. These impurities, after the metal 14 has melted, generally separate at the surface of the liquid metal 7 contained in the container 6. If the composition of them is unfavorable and leads to them having a melting point greater than that of the liquid metal 7, they progressively form a solid crust of increasing thickness at the surface of the liquid metal 7. This crust may end up constituting a serious impediment to the injection of the powder or granules of solid metal 14 into the liquid metal 7. In order to overcome this problem, it is advisable to form, at the surface of the liquid metal 7 contained in the container 6, a layer of slag 27 having a composition such that it remains in the liquid state at the treatment temperature, even when it is combined with the separated nonmetallic impurities. For example, if an Fe-Si-B alloy is cast from a quartz crucible, the slag added is a slag saturated with silica and containing boron oxides.

One way of forming this layer of slag 27 may be to inject into the container 6, at the same time as the initial charge of solid metal 14, the quantity of slag 27 which is estimated in advance to be sufficient to absorb and to liquefy all the nonmetallic impurities which separate therefrom throughout casting. However, there is a risk that this quantity may turn out to be insufficient and that, before the end of casting, the slag 27 ends up by being saturated in impurities and solidifies. What is more, the premature addition of a large quantity of slag 27, if the latter contains constituents (such as fluxes) which attack the container 6, runs the risk of leading to significant and premature wear of the latter. This is why it may also be envisaged to form the layer of slag 27 progressively. This may be achieved by mixing a certain predetermined proportion of fresh slag 30 to the solid metal 14 intended to be injected into the container 6 during casting. This may also be achieved by injecting the fresh slag of a predetermined composition, continuously or intermittently, into the container 6 by means of a second device (not shown), identical in its principle to that which has just been described for injecting the solid metal 14. This latter solution is advantageous in that it enables the added quantity of fresh slag to be adjusted as a function of the actual requirements and not solely as a function of the requirements estimated from previous experiments. For this purpose, the actual requirements in terms of fresh slag may be determined, especially, by visually monitoring the more or less liquid or solid state of the layer of slag 27. This is easy when the metallurgy of the cast metal enables a transparent quartz container 6 to be used, or if a quartz window may be provided in the wall of the container 6 which would otherwise be made of an opaque material. It may also be envisaged to insert into the lid 11 of the container 6 an optical fiber oriented towards the surface of the slag 27 and connected to a camera, so as to have a permanent picture of this surface. Moreover, such a slag may also be injected for metallurgical purposes, for example for desulfurizing the ferrous alloys. Optimally, instead of injecting a slag of predetermined composition into the container 6, it may also be envisaged that the slag injected be taken off from a mixing cheer, itself connected to hoppers each containing one of the constituents of this slag, it thus being possible to adjust the respective proportions of these constituents as a function of the requirements at the time.

Of course, the invention is not limited to the example which has been described and depicted. In particular, any device for feeding the container 6 with solid metal 14 may be used, and not just an Archimedean screw. It is conceivable to use, for example, a conveyor belt or a vibrating plate. However, the advantages of the Archimedean screw are that it makes the flow rate of solid metal 14 easily adjustable and ensures good reproducibility, that it is simple to construct and that, as a consequence, it is very reliable in its operation.

The invention may be used for the direct casting of wires of any ferrous or nonferrous metal alloys initially in divided form.

We claim:

1. An improved process for the continuous casting of very small-diameter wires directly from liquid metal, according to which said liquid metal is melted inside of and made to flow out of a heated and pressurized container made of a refractory material, forming a jet of liquid metal having a diameter equal to or slightly greater than that of the wire to be cast, and said jet is made to solidify by making it penetrate into a layer of moving cooling liquid deposited on the internal wall of a drum rotating about a horizontal axis, wherein said improvement comprises the step of feeding said container with solid metal from a closed and pressurized vessel during casting to obviate the need for interrupting casting to periodically charge said container with metal.

2. The process as claimed in claim 1, wherein said casting is carried out in the presence of a layer of slag sitting on top of said liquid metal contained in said container, and further comprising the step of controlling the composition of this slag so as to keep it in the liquid state throughout the duration of casting.

3. The process as claimed in claim 2, further comprising the step of adding further components of said slag to said container jointly with said solid metal with which they are mixed.

4. The process as claimed in claim 2, further comprising the step of continuously adding components of said slag to said container, independently of said solid metal.

5. An improved device for the continuous casting of very small-diameter wires directly from liquid metal of the type comprising a drum fitted with means for setting it in rotation about a horizontal axis, a layer of a cooling liquid deposited on the inside surface of said drum, a container made of refractory material, containing said liquid metal, and fitted with an outlet orifice overhanging said layer of cooling liquid, means for melting and heating said liquid metal and means for injecting a pressurized inert gas into said container, wherein the improvement comprises a pressurized vessel containing said metal in a solid state, in divided form, and means for feeding said container, continuously or intermittently, with said solid metal from said vessel under pressure during casting to obviate the need for interrupting casting to periodically charge said container with metal.

6. The device as claimed in claim 5, wherein said means for feeding said container with said solid metal comprises an Archimedean screw, one end of which is inserted into said vessel and the other end of which discharges into said container, said Archimedean screw being fitted with means setting it in rotation about its axis, and with a tube means which jackets it over its path between said vessel and said container for maintaining said pressure of said vessel around said metal as it is fed into said container.

7. The device as claimed in claim 5, further including a second vessel, at atmospheric pressure, containing said solid metal and fitted with means for sending said solid metal into said pressurized vessel.

8. The device as claimed in claim 5, further including means for feeding said container, continuously with substances intended to constitute a layer of slag at the surface of said liquid metal.

9. The device as claimed in claim 5, further including means for feeding said container intermittently with substances intended to constitute a layer of slag at the surface of said liquid metal.

* * * * *